US006897752B2

(12) United States Patent
Dixon et al.

(10) Patent No.: US 6,897,752 B2
(45) Date of Patent: May 24, 2005

(54) MAGNETIC ROLLER AND METHODS OF PRODUCING THE SAME

(75) Inventors: Michael John Dixon, Richmond, KY (US); Robert Edward Hackett, Lexington, KY (US); Joe Leroy McGuire, Lancaster, KY (US)

(73) Assignee: Lexmark International, Inc., Lexington, KY (US)

( * ) Notice: Subject to any disclaimer, the term of this patent is extended or adjusted under 35 U.S.C. 154(b) by 120 days.

(21) Appl. No.: 09/915,133

(22) Filed: Jul. 25, 2001

(65) Prior Publication Data

US 2003/0025583 A1 Feb. 6, 2003

(51) Int. Cl.[7] ..... H01F 7/02
(52) U.S. Cl. ..... 335/306; 399/267; 399/119
(58) Field of Search ..... 335/302–306; 399/100–102, 119, 265–277, 279; 428/36.8, 36.92; 492/8, 18

(56) References Cited

U.S. PATENT DOCUMENTS

| | | | | | |
|---|---|---|---|---|---|
| 5,019,796 | A | * | 5/1991 | Lee et al. | 399/277 |
| 5,319,337 | A | | 6/1994 | Matsunari et al. | |
| 5,384,957 | A | | 1/1995 | Mohri et al. | |
| 5,488,341 | A | | 1/1996 | Yamamoto et al. | |
| 5,555,184 | A | | 9/1996 | Jaskowiak et al. | |
| 5,557,060 | A | * | 9/1996 | Okada et al. | 118/661 |
| 5,565,966 | A | * | 10/1996 | Ochiai et al. | 399/277 |
| 5,570,167 | A | | 10/1996 | Kuroda | |
| 5,583,473 | A | | 12/1996 | Yamashita | |
| 5,655,197 | A | | 8/1997 | Okada et al. | |
| 5,666,620 | A | * | 9/1997 | Kobayashi | 399/273 |
| 5,666,626 | A | * | 9/1997 | Takizawa et al. | 399/286 |
| 5,705,448 | A | | 1/1998 | Sambrook et al. | |
| 5,733,580 | A | | 3/1998 | Ikuma et al. | |
| 5,915,147 | A | | 6/1999 | Kouno et al. | |
| 5,946,535 | A | | 8/1999 | Aoki | |
| 6,021,296 | A | | 2/2000 | Tamura et al. | |
| 6,567,641 | B1 | * | 5/2003 | Stack et al. | 399/330 |

FOREIGN PATENT DOCUMENTS

| | | | | |
|---|---|---|---|---|
| JP | 402296267 A | * | 12/1990 | 399/119 |

OTHER PUBLICATIONS

Uniroyal Chemical Company, Inc., "Specialty Additives & Intermediates—Foaming Agents", Celogen® Foaming Agents—Injection Molding with Celogen, Uniroyal Chemical Company, Inc. (Connecticut) (10 pages) (1997).

General Electric Company—GE Plastics, "Engineering Structural Foam Resins", Properties Guide, General Electric Company (Pittsfield, MA), (1988), no month.

Borg Warner Chemicals, Inc., "Prevex® Polymers Structural Foam Grades", Borg Warner Chemicals, Inc., Technical Publication PR 105B, (West Virginia), no date.

Eiwa Chemical Ind. Co., Ltd., "A Guide for Blowing Agent", Eiwa Chemical Ind. Co., Ltd., Technical Publication, (Japan)(11 pages), no date.

Trexel, Inc., "MuCell® Microcellular Foam Process Technology", Trexel, Inc., Technical Publication, (Massachusetts), no date.

Uniroyal Chemical Company, Inc., "Specialty Chemicals—Foaming Agents", Celogen® Foaming Agents, Uniroyal Chemical Company, Inc. (Connecticut) (19 pages)(1995), no month.

Imorpyal Chemical Company, Inc., "Specialty Additives & Intermediates—Foaming Agents", Celogen® Foaming Agents—Injection Molding with Celogen, Uniroyal Chemical Company, Inc. (Connecticut) (10 pages)(1997), no month.

Trexel, Inc., "The MuCell® Molding Technology: Microcellular Foam", David Pierick, Technical Paper (presented at Molding '99 (technical seminar)), (New Orleans, LA) (11 pages)(1999), no month.

* cited by examiner

*Primary Examiner*—Lincoln Donovan
(74) *Attorney, Agent, or Firm*—John A. Brady

(57) ABSTRACT

A magnetic roller for electrophotography comprises a foamed resin magnetic material. A method of producing a magnetic roller comprises the steps of providing magnetic filler, a resin binder and a foaming agent in a closed mold; activating the foaming agent in the closed mold; and removing the resulting formed roller from the mold.

10 Claims, No Drawings

MAGNETIC ROLLER AND METHODS OF PRODUCING THE SAME

FIELD OF THE INVENTION

The present invention is directed to magnetic rollers. More particularly, the invention is directed to foamed injection-molded, resin-bonded magnetic rollers.

BACKGROUND OF THE INVENTION

In a conventional electrophotographic recording apparatus, a magnetic roller is used as a developing roller or a cleaning roller. A magnet roller typically comprises a cylindrical permanent magnet, such as a resin-bonded magnet, provided with a plurality of magnetic poles on the outer surface thereof and a shaft secured to the cylindrical permanent magnet.

Multipole magnetic rollers are typically made of sintered, discrete magnets mounted on a fluted shaft, or of a compounded mixture of magnetic powder and resin to form a so called resin-bonded magnet. Resin-bonded magnets are primarily used when weight reduction of the developer roll is desired or when a unique shape is desired. When a cylindrical permanent magnet is a resin-bonded magnet, the magnetic roller is produced typically by (1) blending a ferromagnetic powder (usually ferrite powder) and a polymer material (usually rubber or plastic) to prepare a mixture, (2) charging the mixture into a cavity of an injection-molding die while applying a magnetic force thereto, (3) cooling and solidifying the cylindrical resin-bonded magnet in the die, (4) removing a fully magnetized integral body composed of the cylindrical, resin-bonded magnet and shaft, and (5) magnetizing the integral body in appropriate anisotropic directions to form magnetic poles on the cylindrical resin-bonded magnet, thereby obtaining the complete magnetic roller.

Production of magnetic rollers typically causes mold wear as a result of the high ferric content of the ferrite/polymer mixtures and as a result of high pressures used during molding. In addition, to be useful, a magnetic roller must have the correct combination of physical, morphological and magnetic properties. These properties are greatly affected by straightness of the magnetic roller, and the straightness is degraded in direct relationship to molded "stress" in the roller. Molded in "stress" is directly related to higher molding pressure.

The cost of the magnetic rollers is typically a function of raw material, processing and handling costs. Thereby, lower material usage, shorter processing times and/or less handling may potentially reduce the cost of each magnetic roller. In addition, a reduction in the amount of material allows faster cooling of the magnetic roller and improved cycle times allowing more magnetic rollers to be produced from each individual mold. Cycle time describes the amount of time to produce a magnetic roller in an injection-molding machine.

Typically, manufacture of magnetic rollers requires a high clamp pressure and a high molding pressure. Formulations which allow reductions in clamp pressures and/or molding pressures, further allow magnetic roller to be made on smaller, less expensive presses. In addition, current conventional manufacturing techniques often incur high scrap rates from restarts after cleaning of flash from the mold. The generation of flash is a function of manufacturing pressure, wherein lower pressure during production of a magnetic roller typically reduces flash and accordingly increases throughput. Additionally, lower molding pressures reduce molded in stress and result in more dimensionally accurate ports.

Thus, the need exists for improved magnetic rollers and/or improved manufacture of magnetic rollers.

Foam molding is known and the foregoing advantages are known to result from foam molding, particularly because internal pressures in the mold are significantly reduced by the action of gases formed during molding

SUMMARY OF THE INVENTION

Accordingly, it is an advantage of the present invention to provide magnetic rollers which are subject to much less defects from molding, which reduce the cycle time of molding, which cause much less internal wear in the mold, and which comprise a reduction in material as compared with conventional magnetic rollers, while having mechanical and/or magnetic properties similar to conventional magnetic rollers. More particularly, it is another advantage of the present invention to provide foamed magnetic rollers which exhibit magnetic and mechanical properties equal or better than non-foamed magnetic rollers.

These and additional objects and advantages are provided by the magnetic rollers and methods of producing the same according to the present invention in which the magnetic roller comprises a foamed resin magnetic material.

Generally, the magnetic rollers comprise a foamed resin magnetic material. The foamed resin magnetic material comprises magnetic filler and resin binder.

The present invention is also directed to methods for forming a magnetic roller. The methods comprise the steps of providing magnetic filler, a resin binder and a foaming agent in a closed mold; releasing gases in the closed mold; and removing the resulting formed roller from the mold. A magnetic filler, a resin binder and a foaming agent are intimately mixed in the barrel of the injection molding machine, both chemically and thermally. Gas is released by thermal decomposition and/or expands but at reduced pressure in the mold until the total volume (the melt with internal voids filled with gas) increases enough to fill the mold.

The magnetic rollers may be easily manufactured and exhibit desirable combinations of magnetic and mechanical properties. These and additional objects and advantages will be further apparent in view of the following detailed description.

DETAILED DESCRIPTION

The magnetic rollers according to the present invention are suitable for use in electrophotographic apparatus. Throughout the specification, the terms "foaming" and "blowing" are used interchangeably and are intended to mean the same thing. In one embodiment of the present invention, a chemical blowing or foaming agent is added to the mixture of magnetic filler and resin binder in a non-activated form, and during molding the foaming agent releases gas within the resin binder. The chemical foaming agent may be added in pellets, powder or liquid. In an exemplary embodiment, the chemical blowing agent comprises pellets which enable easy mixing with the magnetic filler and the resin binder which is usually in pellet form as well. Typical chemical blowing agents include but are not limited to EXPANDEX 5PT from Uniroyal Chemical, FCN 1/8 50B from DSM Engineering Plastics and TRACEL PS 3200.

In one exemplary embodiment, the chemical blowing agent or foaming agent releases a gas such as nitrogen or carbon dioxide or both as the agent is heated inside the barrel of the injection machine and in the mold after injection.

Inside the mold the gas is released at lower pressure than would normally be present. The release of a gas provides pressure inside the mold during molding resulting in foaming of the resin binder. Typically, the internal pressure in the closed mold pushes the magnetic filler/resin binder to the outside edges of the mold and leaves small voids at the center of each part, but, when the amount of gas is limited, does not extend the voids to the outer regions.

In another embodiment of the present invention, a liquid blowing agent, for example a liquid blowing agent such as that created by the "MuCell®" process from Trexel, Inc., is injected into the barrel of the molding machine and under heat. The liquid blowing agent develops internal gas pockets or cells within the resin binder. MuCell microcellular foam processes use supercritical fluids of atmospheric gases to create evenly distributed and uniformly sized microscopic cells through the resin binder. Typical cells range from 10 micrometers to 50 micrometers in diameter. In an exemplary embodiment, the cells are approximately 20 micrometers in diameter. Typical liquid blowing agents include supercritical fluids (SCFs) of atmospheric gases (such as $CO_2$ and $N_2$).

The magnetic roller of the invention comprises a foamed resin magnetic material. In one embodiment, the foamed resin magnetic material comprises from about 80 to about 95 weight percent of magnetic filler and from about 5 to about 20 weight percent of resin binder.

A typical magnetic filler may comprise a ferrite filler, for example barium ferrite and/or strontium ferrite. Other typical magnetic fillers comprise a rare earth-cobalt alloy, a rare earth iron-boron alloy, or mixtures thereof, or mixtures of one or more of such alloys with one or more ferrite fillers.

Any suitable resin binder may be employed in the magnetic rollers. In one embodiment of the present invention, the resin binder comprises polyvinyl chloride, polypropylene or nylon. Examples of the nylon include, but are not limited to nylon-6, nylon-12, nylon-6/6, and nylon 6/12.

In an exemplary embodiment of the present invention, the foamed resin magnetic material further comprises glass fibers, carbon filler, or mixtures thereof. Inclusion of glass fibers can improve the strength of the foamed magnetic material. Inclusion of carbon filler yields an electrically conductive part. The magnetic rollers may further include any additives conventionally employed in the art, including, but not limited to, plasticizers, oxidizers, couplers and the like.

Although not bound by theory, the inventors believe the capacity of the magnetic roller to accept magnetic properties as well as the uniformity of these properties is dependent on consistent magnetic filler being available at the surface of the magnet. In one exemplary embodiment, the internal foaming agent accomplishes this requirement as it expands the melt under heat, wherein the foaming agent decomposes from a solid to a gas, forces the magnetic filler and resin binder mixture to the outside edge of the mold, and creates resulting gas pockets in the magnetic filler and resin binder mixture. As the gas forces the magnetic filler to the outside edge of the mold, the consistency of magnet filler at the surface of the magnetic roller is increased.

In one embodiment, the foaming agent is provided in an amount of from about 0.1 to about 1.5 weight percent, based on the weight of the resin binder.

In an exemplary embodiment of the present invention, the magnet filler, resin binder and foaming agent are added to a secondary hopper in pellet form. The magnetic roller may be formed using any injection molding mold and injection molding machine.

In another exemplary embodiment, the magnetic roller contains at least 5% less by weight of the magnetic filler and resin binder combined as compared with a same-sized magnetic roller formed from non-foamed magnetic filler and resin binder while exhibiting substantially equivalent magnetic performance as such a same-sized magnetic roller, for example, 1,000 gauss over the usable length of the magnet. In yet another embodiment, a magnetic roller of the present invention contains at least 5% less by weight of the magnetic filler and resin binder combined as compared with a same-sized magnetic roller formed from non-foamed magnetic filler and resin binder while exhibiting substantially equivalent mechanical strength as such a same-sized magnetic roller. For example, a foamed magnet can withstand a 15 to 22 kilogram force applied to its center while supporting it only from the ends on the axles. This equivalent mechanical strength means the magnet will not likely be damaged in shipment to the manufacturing facility or to the end user. A broken magnet renders a printer cartridge useless.

A preferred formulation for this invention is, by weight strontium ferrite (as commercially available)–88%

Nylon 6 (or any of the foregoing nylon 6's)–11%

FCN 1/850B blowing agent–0.05%

Plasticizers, binders and the like (standard discussed below)–1%

The preferred product is a magnetic roller having a long center which is cylindrical and subject to very close tolerance as to roundness and which has central shafts extending from each end which are both molded as an integral part of the roller. The shafts are smaller than the roller and may have flats for contacting a driving member in a given application. The shafts are to serve as journals and in all respects regarding rotation around the shafts the shafts are also subject to very close tolerances. U.S. Pat. No. 5,583,473 to Yamashita is illustrative of the general nature of this roller, but not of foamed construction and not having both shafts integrally molded (one is press fit). FIG. 3(b) of U.S. Pat. No. 5,583,473 shows such a roller with both shafts integrally formed.

Examination of a cross section of this roller injection molded as discussed below would show some small bubbles clustered near the center and no bubbles near the outside. To the extent the bubbles exist, the weight of the roller is reduced. Savings of the cost of materials and expense of handling and shipment are realized from the weight reduction. Major advantages result however, even if the final product has very few or no bubbles, so long as the molding employs internal pressure from a blowing agent, since as discussed scrap rates, cycle time, and mold wear are greatly improved.

The following example demonstrates an embodiment and advantages of a magnetic roller according to the present invention. In this example and throughout the present specification, parts and percentages are by weight unless otherwise indicated.

EXAMPLE

In this example, magnetic rollers according to the present invention were prepared. Suggested formulations of the magnetic rollers are listed in Table 1, with standard roller A being a comparative roller manufactured without a foaming agent.

TABLE 1

| Roller | % Foaming Agent vs. Resin Binder | Strontium Ferrite % Magnetic Filler | Nylon 6 % Resin Binder and Additives |
|---|---|---|---|
| Standard A | 0.0% | 85% | 15% |
| Trial B | 0.05% | 85% | 15% |
| Trial C | 0.10% | 85% | 15% |
| Ttial D | 0.15% | 85% | 15% |
| Trial E | 0.4% | 85% | 15% |
| Trial F | 0.5% | 85% | 15% |
| Trial G | 0.6% | 85% | 15% |
| Trial H | 0.7% | 85% | 15% |
| Trial I | 0.8% | 85% | 15% |
| Trial J | 0.9% | 85% | 15% |
| Trial K | 1.0% | 85% | 15% |
| Trial L | 1.5% | 85% | 15% |
| Trial M | 2.0% | 85% | 15% |

The magnetic rollers were prepared as described below

Magnet Processing Method with Foam

This processing method utilizes a standard molding machine with an optional positive shut-off nozzle and optionally may also include a digital dosing hopper. The compounded magnet material is dried for about 4–6 hours. This compounded material includes magnet filler, resin and as small amount additives such as plasticizers, binders and the like which vary with the molding service used (and are typically proprietary to the molding service used). The additives improve "melt" flow. The additives typically comprise approximately 0.5~1% by weight of the materials. The blowing agent (foaming agent) maybe added before or after the drying step and optionally may be added utilizing a digital dosing hopper. The shot size on the molding machine is adjusted for approximately a 4 to 20% reduction in weight, depending on the amount of blowing agent. More specifically, good results have been achieved at 12%.

Typical processing parameters include fastest possible injection speed (typically less than 3 seconds). The screw typically at injection is applied when the total melt is slightly less in size than the mold cavity, but in large enough amount so that the expansion of the gas results in a filled mold cavity. (This amount to inject is determined by experiment.). The clamp pressure is typically 50% of normal. A reversed barrel temperature profile is established which has a lower than normal rear temperature zone as is standard to hold gases within the barrel. The molding machine has higher than usual back pressure of 150–200 psi (normal back pressure is typically 60 psi). Typical normal melt temperatures are used with nylon 6 for example at about 555–560° F.

For each of the magnetic rollers produced, the following tests were performed: straightness measurement, tensile strength, and magnetic variation. Straightness was measured using electronic calipers, a comparator and/or a coordinate measuring machine; tensile strength was determined utilizing a 22 kg force gage to check for fragility when the parts were subjected to a 15 kg load applied to the center of the magnetic roller while supporting the magnetic roller at the end shafts; magnetic variation was determined by comparing the magnetic field for magnetic rollers of the present invention against conventional non-foamed magnetic rollers; and the magnetic measures were measured at pole angles relative to the locating feature (end shaft flat).

Table 2 summarizes the results of this example.

TABLE 2

| Effect of "Foam" on Strength, Straightness and/or Magnetic Performance | | | | | |
|---|---|---|---|---|---|
| Roller | % Foaming Agent vs Resin Binder | Runout[1] (Straightnes) | Flexural Break Strength[2] | Total Material Savings | Magnetic Variation[3] |
| Standard | 0.00% | 0.6 | 22 kg-f | 0% | ±6% |
| Trial B | 0.05% | 0.5 | 22 kg-f | 4% | ±5% |
| Trial C | 0.10% | 0.4 | 22 kg-f | 4% | ±4% |
| Trial D | 0.15% | 0.3 | 22 kg-f | 5% | ±3% |
| Trial E | 0.4% | 0.2 | >25 kg-f | 6% | ±2% |
| Trial F | 0.5% | 0.2 | >25 kg-f | 7% | ±2% |
| Trial G | 0.6% | 0.2 | >25 kg-f | 8% | ±2% |
| Trial H | 0.7% | 0.2 | 10 kg-f | 8% | ±2% |
| Trial I | 0.8% | 0.2 | 10 kg-f | 9% | ±2% |
| Trial J | 0.9% | 0.2 | 10 kg-f | 9% | ±2% |
| Trial K | 1.0% | 0.2 | 5 kg-f | 10% | ±2% |
| Trial L | 1.5% | 0.2 | 5 kg-f | 12% | ±2% |
| Trial M | 2.0% | 0.2 | 5 kg-f | 20% | ±5% |

Typical compounded nylon material with fillers such as glass carbon or magnetic ferrite material.
[1]Runout (straightness) measurements are equal to 2× straightness, but runout measurements take into account end shaft variation.
[2]Magnetic rollers supported at the ends and force applied at the center.
[3]Magnetic measurements typically −1,000 gauss 2%, ±20 gauss.
[4]Rollers E, F, I and J represent extrapolated data based on trials with greater or lesser amounts of foam.

As can be noted from Table 2, up to a 12% reduction in weight (TRIAL L) and a 0.2 mm circular run-out reduction can be achieved by utilizing the present invention. Too high a level of foam, however, can have a deleterious effect on the internal structure and/or on the properties of the outer skin of the magnets.

The foamed magnetic rollers were inspected using a 50 to 1 stereo microscope to determine foam cell structure and morphology. These tests indicated varying degrees of voids axially along the center of the rollers proportional to the amount of foam used.

The foregoing description of the various embodiments of the invention has been presented for the purposes of illustration and description. It is not intended to be exhaustive or to limit the invention to the precise form disclosed. Many alternatives, modifications, and variations will be apparent to those skilled in the art of the above teaching. Accordingly, this invention is intended to embrace all alternatives, modifications and variations that have been discussed herein, and others that fall within the spirit and broad scope of the claims.

What is claimed is:

1. A magnet roller comprising a foamed mixture of resin and magnetic material having no bubbles of said foam at the outside of said roller.

2. The magnetic roller of claim 1, wherein the foamed resin magnetic material comprises from about 80 to about 95 weight percent of magnetic filler and from about 5 to about 20 weight percent of resin binder.

3. The magnetic roller of claim 2, wherein the magnetic filler comprises a ferrite filler.

4. The magnetic roller of claim 2, wherein the magnetic filler comprises barium ferrite, strontium ferrite, a rare earth-cobalt alloy, a rare earth iron-boron alloy, or mixtures thereof.

5. The magnetic roller of claim 2, wherein the resin binder comprises nylon.

6. The magnetic roller of claim 2, wherein the resin binder comprises nylon-6, nylon-12, nylon-6/6, nylon 6/10, nylon 6/12, polyvinyl chloride or polypropylene.

7. The magnetic roller of claim 4, where the ferrite filler comprises strontium ferrite filler.

8. The magnet roller of claim 2, wherein the foamed mixture of resin binder and magnetic material further comprises glass fibers, carbon filler, or mixtures thereof.

9. The magnetic roller of claim 1, wherein the roller contains at least 5 weight percent less of said magnetic filler and said resin binder as compared with the same sized roller formed from non-foamed said magnetic filler and said resin binder and exhibits substantially equivalent magnetic performance as such a same sized roller.

10. The magnetic roller of claim 2, wherein the roller contains at least 5 weight percent less of said magnetic filler and said resin binder as compared with the same sized roller formed from non-foamed said magnetic filler and said resin binder and exhibits substantially equivalent mechanical strength as such a same sized roller.

* * * * *

UNITED STATES PATENT AND TRADEMARK OFFICE

CERTIFICATE OF CORRECTION

PATENT NO. : 6,897,752 B2
DATED : May 24, 2005
INVENTOR(S) : Dixon et al.

It is certified that error appears in the above-identified patent and that said Letters Patent is hereby corrected as shown below:

Column 6,
Lines 51-53, replace claim 1 with the following claim 1.
1. A magnet roller comprising a foamed mixture of resin binder and magnetic material having no bubbles of said foam at the outside of said roller, said roller containing up to 12 weight percent less of said magnetic material and said resin binder as compared with the same sized roller formed from non-foamed said magnetic material and said resin binder.

Signed and Sealed this

Fifteenth Day of November, 2005

JON W. DUDAS
*Director of the United States Patent and Trademark Office*